United States Patent [19]

Weber

[11] 4,056,858

[45] Nov. 8, 1977

[54] INFLATABLE CUSHION AND METHOD OF MAKING THE SAME

[76] Inventor: Carl W. Weber, 201 N. Main St., Van Buren, Ohio 45889

[21] Appl. No.: 627,521

[22] Filed: Oct. 31, 1975

[51] Int. Cl.[2] ..... A47C 4/54; B32B 31/04

[52] U.S. Cl. ..... 5/365; 5/350; 156/290; 156/583; 428/35; 428/166; 428/178; 428/192; 428/198; 428/332

[58] Field of Search ..... 428/35, 166, 192, 198, 428/178, 158, 159, 332; 156/156, 273, 290, 581; 5/365, 345 R, 350; 9/13, 11 A

[56] References Cited

U.S. PATENT DOCUMENTS

| | | | |
|---|---|---|---|
| 2,522,079 | 9/1950 | Winstead | 5/365 |
| 2,936,816 | 5/1960 | Lang | 156/273 |

FOREIGN PATENT DOCUMENTS

| | | | |
|---|---|---|---|
| 3,783 of | 1876 | United Kingdom | 5/365 |

*Primary Examiner*—William J. Van Balen
*Assistant Examiner*—P. J. Thibodeau
*Attorney, Agent, or Firm*—Oltsch & Knoblock

[57] ABSTRACT

An inflatable cushion formed of marginally bonded superimposed flexible thermoplastic sheet material characterized by a plurality of substantially uniformly spaced thermally bonded areas each of a thickness less than the combined thickness of the component sheet material and characterized by a plurality of integral closely spaced ribs projecting from one surface, and by a marginal integral portion of greater thickness than the combined thicknesses of the component sheet material. The bonded areas are formed by a method wherein superimposed sheets are pressed to a predetermined extent between a supporting surface and a die heated to a temperature above the melting point of the thermopolastic sheet material and characterized by a plurality of closely spaced ribs substantially uniformly engaging said sheet material while bearing on said supporting surface.

2 Claims, 5 Drawing Figures

INFLATABLE CUSHION AND METHOD OF MAKING THE SAME

SUMMARY OF THE INVENTION

This invention relates to an inflatable cushion and method of making the same.

Inflatable cushions have long been known but have achieved limited acceptance because of certain characteristics thereof. Thus, prior constructions have entailed the marginal bonding or adhesion of two or more sheets or layers of resilient material, such as rubber, artificial rubber or thermoplastic flexible sheet material, and the bonding or adhesion of the layers at spaced intervals throughout the area of the cushion to limit the thickness to which the cushion may be inflated and to produce an appearance or shape of the inflated cushion simulating quilting. The bonding or adhesion at spaced intervals has been difficult and expensive to accomplish in prior constructions, has required reinforcement at the bonded area or had other limitations and disadvantages. One common disadvantage experienced in prior inflatable cushions has been a tendency of the sheets to separate or to tear at the bonded or adhered areas, with the result that the seal of the unit was broken at a tear so that the cushion deflated, or that separation of the sheets produced undesirable bulging of the cushion at areas adjacent the separation.

It is the primary object of this invention to provide an inflatable cushion which overcomes the aforementioned and other disadvantages of prior units and which can be produced by a novel inexpensive method.

A further object is to provide an inflatable cushion formed of superimposed thermoplastic flexible sheets heat bonded at substantially uniformly spaced points in a manner to provide a strong cohesive bond at each area which will resist separation and breakage.

A further object is to provide an inflatable cushion formed of a pair of sheets of superimposed thermoplastic flexible material bonded at their margins and at spaced points throughout the cushion each surrounded by a thickened perimetral reinforcing rib portion.

A further object is to provide an inflatable cushion formed of superimposed thermoplastic sheets heat bonded at spaced intervals, said bonding occurring at endless portions and characterized by inner and outer substantially continuous reinforcing ribs.

A further object is to provide a method of forming an inflatable cushion wherein superimposed thermoplastic sheets are subjected to pressure between a heated member and a backing member, said heated member having a plurality of endless ribs spaced substantially uniformly and at distances which ensure heating and bonding of the sheet material at and between said ribs.

Other objects will be apparent from the following specification.

Figure 1:
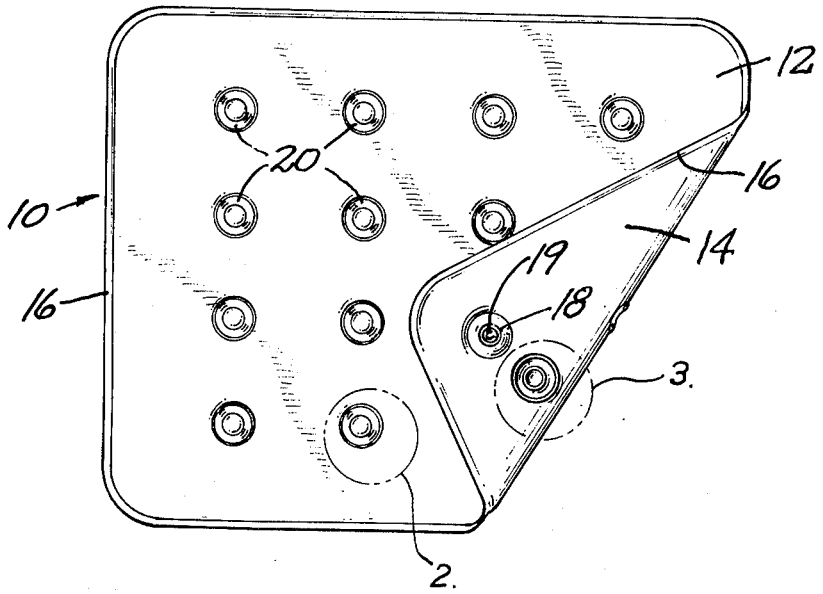
FIG. 1 is a plan view of the cushion having a portion thereof folded to expose the reverse face thereof.

Referring to the drawing, which illustrates a preferred embodiment, the numeral 10 designates a cushion which is formed of two sheets 12 and 14 of flexible thermoplastic sheet material. One example of such material is polyvinylchloride, but other thermoplastics are equally suitable as well understood in the thermoplastic art. The two sheets are arranged in superimposed relation and are bonded at their margins 16 continuously, as by heat and pressure, to form a continuous marginal seal.

One of the sheets, here shown as the sheer 14, has an opening 18 formed therein spaced from the bonded margin 16 at which is marginally bonded or adhered a valve 19, preferably of thermoplastic material and of any suitable construction which will accommodate an inflatable nozzle or tool and which is manually operable or opened to accommodate deflation of the cushion.

Figure 2:
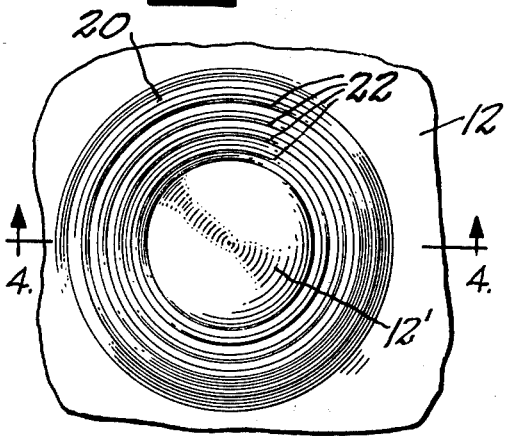
FIG. 2 is an enlarged detail elevational view of one face of an adhered area of the cushion.
Figure 3:
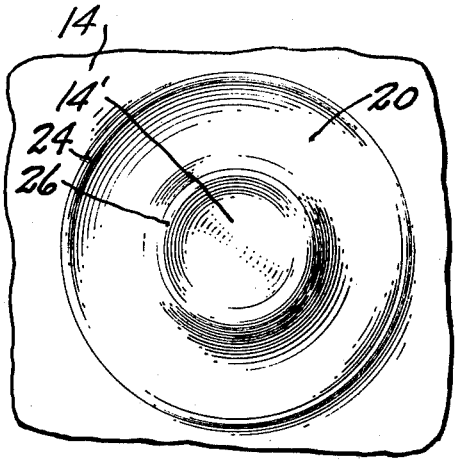
FIG. 3 is an enlarged detail view illustrating the appearance of an area of the cushion reverse or opposite that shown in FIG. 2.
Figure 4:
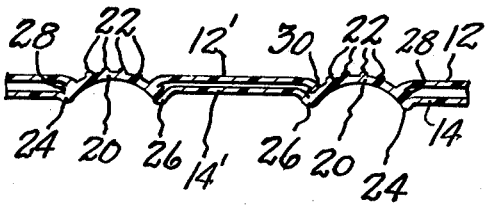
FIG. 4 is a fragmentary transverse detail sectional view taken on line 4—4 of FIG. 2.

At a plurality of substantially uniformly spaced apart points or locations in the product which are spaced inwardly from the margin 16 small areas of the sheets 10 and 12 are bonded together, preferably by heat sealing thereof. Each of the bonded or cohered areas, generally designated 20, is preferably endless and of substantial width. Thus each bonded area may be circular, as shown in FIGS. 2 and 3, or of any other desired shape. The bonded areas 20 are preferably spaced from each other and from the margins 16 a distance not greatly exceeding three inches, and, where circular, are of approximately one inch in outer diameter and approximately one-half inch in inner diameter. These dimensions are optional, but I prefer that the width of the bond at all portions of each area 20 be of a width of one-eighth inch or more. Each bonded area 20 is characterized by a plurality of substantially similar endless ribs 22 projecting from one face of the area. Ribs 22 are substantially uniformly spaced, and are here shown as four in number. The bonded area 20 is encircled by an outer substantially endless ribs 24 projecting from the surface opposite that from which the ribs 22 project and also by an inner substantially endless rib 26 projecting from the same surface, that is, in the same direction as the rib 24. The bonded part 20 may arch transversely between the ribs 24 and 26. The bond between the sheets is also characterized by a substantially endless rib or bulge 28 occurring between the sheets 12 and 14 extending around the outer margin of the bonded area 20 and by a similar substantially endless rib 30 between the sheets 12 and 14 around the inner margin of the bonded area 20, as best seen in FIG. 4. Stated differently, the portion of the bonded area 20 at its marginal junction with the separate sheets 12 and 14 both around and within each endless bonded area 20 is of increased thickness, as compared to the thickness of the bonded area 20 and to the combined thicknesses of the sheets 12 and 14. The portions 12' and 14' of the sheets 12 and 14 which are positioned within or are surrounded by each endless bonded area 20 are independent and preferably non-adhered or non-bonded.

By virtue of the character of the bonded areas and the reinforcing function of the ribs 22, 24, 26 and 28, any tendency of the sheets 12 and 14 to separate or pull apart during rough handling or in use as a cushion while inflated is effectively resisted so that the two sheets cannot start to separate or to peel apart. Also the reinforcement at the marginal junction of each sheet with the bonded area 22 resists tear and accidental breakage of a sheet which would produce leakage of air from the cushion.

Figure 5:
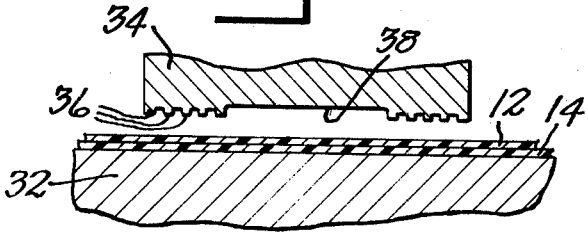
FIG. 5 is a transverse sectional view of means employed in the method of producing the adhered areas illustrated in FIGS. 2, 3 and 4.

The method of forming the bonded areas 20 is best illustrated in FIG. 5 and entails the positioning of the superimposed flexible thermoplastic sheets 12 and 14 upon the flat surface of a supporting member 32 and the application of pressure against the superimposed sheets by a heated die 34. The die is heated to a temperature exceeding the melting point of the thermoplastic sheets 12 and 14 so that the areas of the sheets 12 and 14 contacted by or adjacent to surfaces of the die are caused to melt and bond together. The web-contacting surfaces of the die are characterized by a plurality of endless ribs 36 which are substantially uniformly spaced and in the present instance are five in number where four ribs 22 are to be produced upon the bonded area 20 of the cushion. The crests of ribs 36 are substantially in a common plane parallel to the surface of support 32 which they confront. The surface portion 38 of the die within the outline of the innermost rib 36 is relieved or inset. The superimposed sheets 12 and 14 are subjected to sufficient pressure between the die ribs 36 and support 32, as determined by the throw or stroke of the die to slightly reduce the combined thickness of the sheets 12 and 14 at the areas contacted by the die ribs 36. The die is held in selected spacing to support 32 for a sufficient period of time to permit heating, bonding and flow of the thermoplastic of the sheet material to enter the space between the die ribs 36 so as to form the ribs 22 of the bonded area 20. Also, heated plastic is laterally displaced from the zones contacted by the ribs and thus forms the increased thickness portions at the ribs 24, 26, 28 and 30. The temperatures required will be dependent upon the character and melting point of the thermoplastic sheet material utilized.

The method permits the production of a shape and cross section as previously described without requiring the use of a mold cavity in the support 32. Thus only the shape, size and spacing of the ribs 36 are required to guide reshaping of the heated plastic as it bonds at 20 and forms the ribs 22, 24, 26, 28 and 30.

The various bonded areas 20 are preferably formed simultaneously, but may be formed individually or in groups. Also, if desired, the support 32 may be heated as well as the die. The formation of the marginal bond 16 is also preferably accomplished by and between heated dies, which contact and compress the margins of the sheets and may be done independently of the formation of areas 20 or simultaneously with formation of areas 20.

While the preferred embodiment of the invention has been illustrated and described, it will be understood that the dimensions and shape of the bonded areas 20 are optional and that other embodiments of the invention may be made within the scope of the appended claims.

What I claim is:

1. In an inflatable cushion comprising two sheets of flexible thermoplastic sheet material bonded marginally and at substantially uniformly spaced intervals and having a valved inflation opening, the improvement wherein each of the spaced bonds comprises a heated bonded area of less thickness than the combined thickness of said sheets and including a plurality of closely spaced integral ribs projecting from one face, said area being surrounded by an integral reinforcing portion of greater thickness than the bonded area and greater thickness than the combined thicknesses of said sheets, and including an integral marginal rib projecting between the portions of the sheets encircled by said endless bond.

2. An inflatable cushion as defined in claim 1, wherein said spaced endless bonded areas are of a width greater than one-eighth inch throughout.

* * * * *